US007833069B2

(12) United States Patent
Wu et al.

(10) Patent No.: US 7,833,069 B2
(45) Date of Patent: Nov. 16, 2010

(54) BATTERY CONNECTOR WITH SPACING STRUCTURE LIMITING DISPLACEMENT OF PRESSED CONTACTS OF BATTERY CONNECTOR

(75) Inventors: Chun-Kwan Wu, Tu-Cheng (TW); Chih-Hsiang Ho, Tu-Cheng (TW); Chi-Nan Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/477,151

(22) Filed: Jun. 3, 2009

(65) Prior Publication Data

US 2009/0298343 A1 Dec. 3, 2009

(30) Foreign Application Priority Data

Jun. 3, 2008 (TW) ..... 97209723 U

(51) Int. Cl.
*H01R 4/48* (2006.01)

(52) U.S. Cl. ..... 439/862; 439/500

(58) Field of Classification Search ..... 439/862, 439/79–80, 566, 570, 31, 500
See application file for complete search history.

(56) References Cited

U.S. PATENT DOCUMENTS

| | | | | |
|---|---|---|---|---|
| 6,361,359 | B1 | 3/2002 | Du et al. | |
| 6,951,488 | B2 * | 10/2005 | Hsieh | 439/660 |
| 7,357,665 | B1 * | 4/2008 | Yan | 439/500 |
| 7,387,541 | B1 * | 6/2008 | Lai et al. | 439/660 |
| 7,575,469 | B1 * | 8/2009 | Hung | 439/500 |
| 7,628,660 | B2 * | 12/2009 | Ma | 439/862 |

* cited by examiner

*Primary Examiner*—Michael C Zarroli
(74) *Attorney, Agent, or Firm*—Wei Te Chung; Andrew C. Cheng; Ming Chieh Chang

(57) ABSTRACT

A battery connector (100) is generally assembled in a corner of a case and includes contacts (2) of the battery connector (100) each have a mating portion (21) defining a rib in the center of the mating portion (21). An insulative housing (1) defining a plurality of slots (111) receiving the contacts (2) therein has recesses (112) in the slots (111). When the contacts (2) is pressed by a battery, the rib (211) is plunged into the recess (112).

9 Claims, 6 Drawing Sheets

BATTERY CONNECTOR WITH SPACING STRUCTURE LIMITING DISPLACEMENT OF PRESSED CONTACTS OF BATTERY CONNECTOR

BACKGROUND OF THE INVENTION

1. Field of the Invention

The present invention relates to a battery connector, and in particularly to a battery connector having a spacing structure permitting a mating section of a contact in the battery connector to displace with respect to a complementary element within a predetermined distance in order to prevent disengagement of the contact and the complementary element.

2. Background of the Invention

Battery connector used in a mobile device is generally positioned in a lateral wall of a case. A plate-shaped battery inserted in the case is pressed to touch contacts of the battery connector.

A battery connector disclosed in U.S. Pat. No. 6,361,359 B1 illustrates a kind of batter connector. The battery connector comprises a housing having slots, a plurality of contacts disposed in the slots. Each contact includes a mating portion, an elastic arm, and a soldering foot in an end thereof. The battery connector is fixed in a corner of two lateral walls meeting with each other. When the battery is inserted into the case, the contacts of the battery connector usually depart from central axis of the slots. It results in a bad contact between the battery and the battery connector.

It is thus desirable to provide a battery connector that alleviates and even overcomes the above disadvantage.

SUMMARY OF THE INVENTION

An object of the present invention is to provide a battery connector designed with a spacing structure permitting a mating section of a contact in the battery connector to displace with respect to a complementary element within a predetermined distance in order to prevent disengagement of the contact and the complementary element.

In accordance with the present invention, a battery connector comprises: an insulative housing having a plurality of passageways extending through the housing along a front-to-back direction; a plurality of terminals received in the respective passageways with each having a mating section extending forwardly from a front face of the housing, a rib defined on the mating section of each of said contacts; a plurality of recesses on said front face of the housing to extend from the front face toward a back face of the housing and being in communication with the respective passageways, each of the recesses in correspondence with each of the ribs and defining opposed side walls to limit the rib of the contact to move along a left-to-right direction within a predetermined distance defined by said opposed side walls of the recess.

BRIEF DESCRIPTION OF THE DRAWINGS

Hereinafter, the above object will become more apparent from the following description for embodiments of the present invention with reference to accompanying drawings.

DETAILED DESCRIPTION OF THE INVENTION

Hereinafter, in order to make the above object, features and advantage to be easily understood, embodiments of the present invention will be described in detail with reference to the accompanying drawings.

Figure 1:
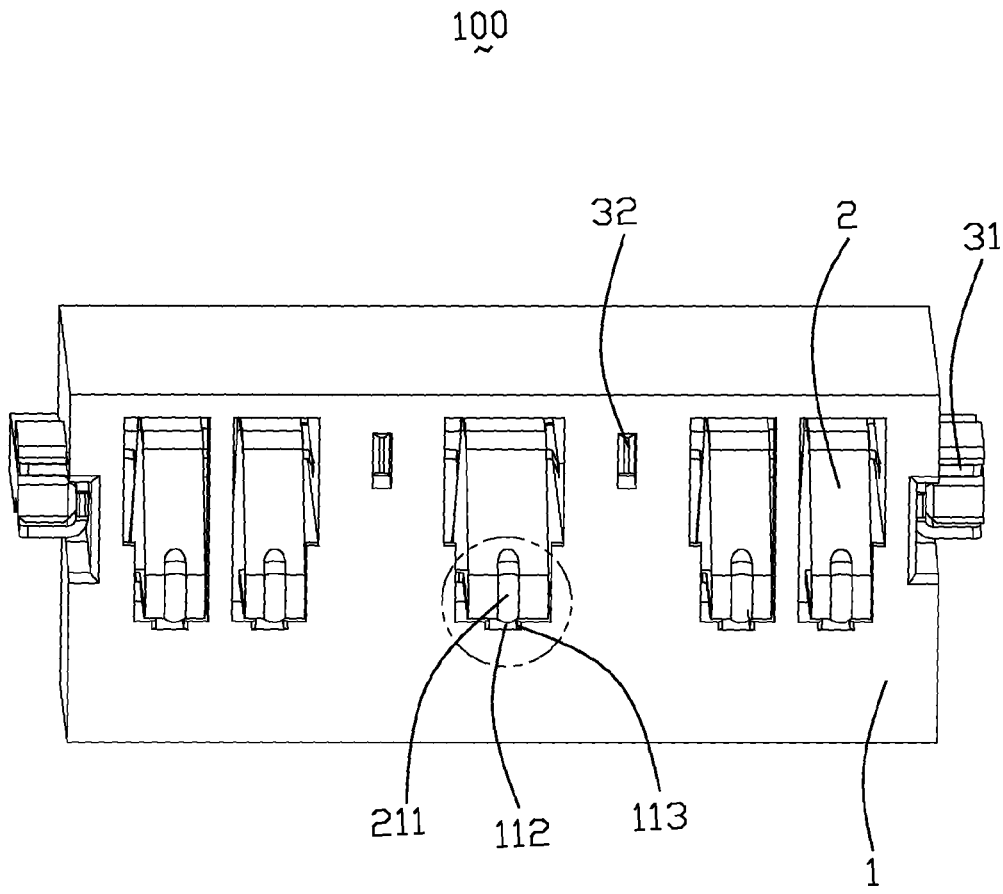
FIG. 1 is an assembled, perspective view of a battery connector.
Figure 2:
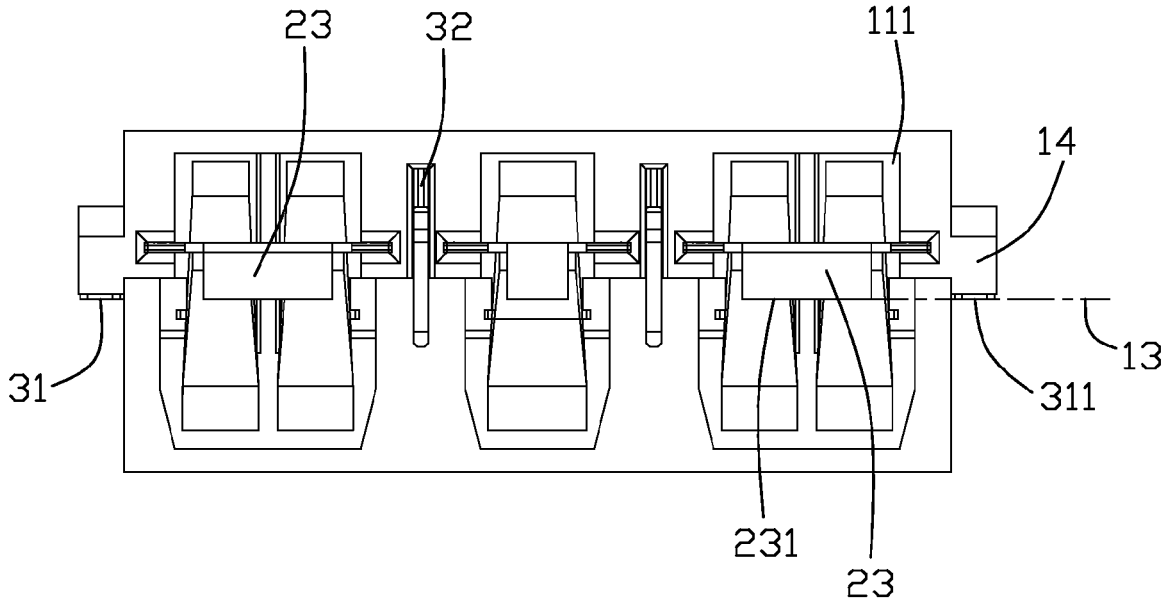
FIG. 2 is another assembled, perspective view of the battery connector of FIG. 1.
Figure 3:
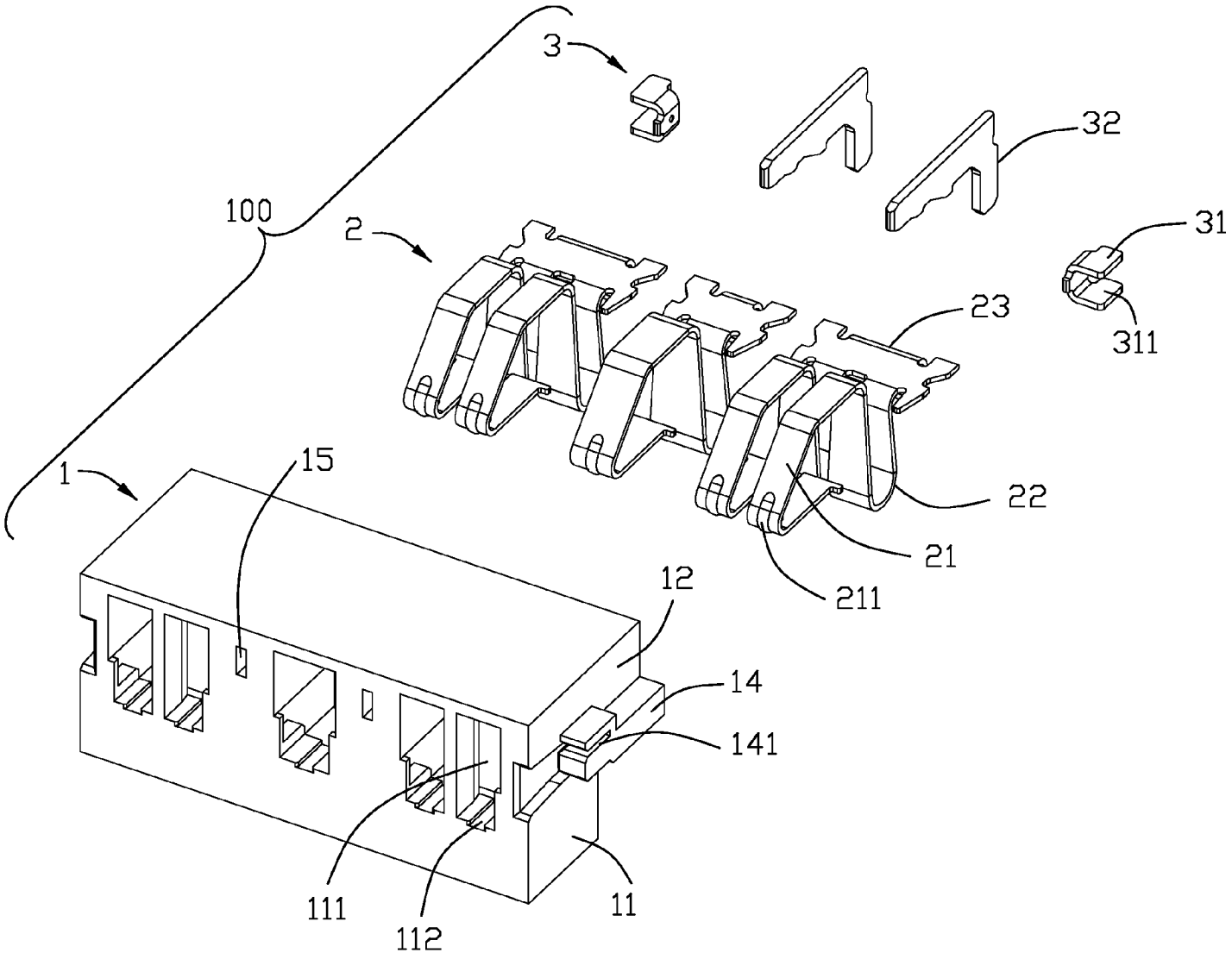
FIG. 3 is an exploded, perspective view of the battery connector of FIG. 1.
Figure 4:
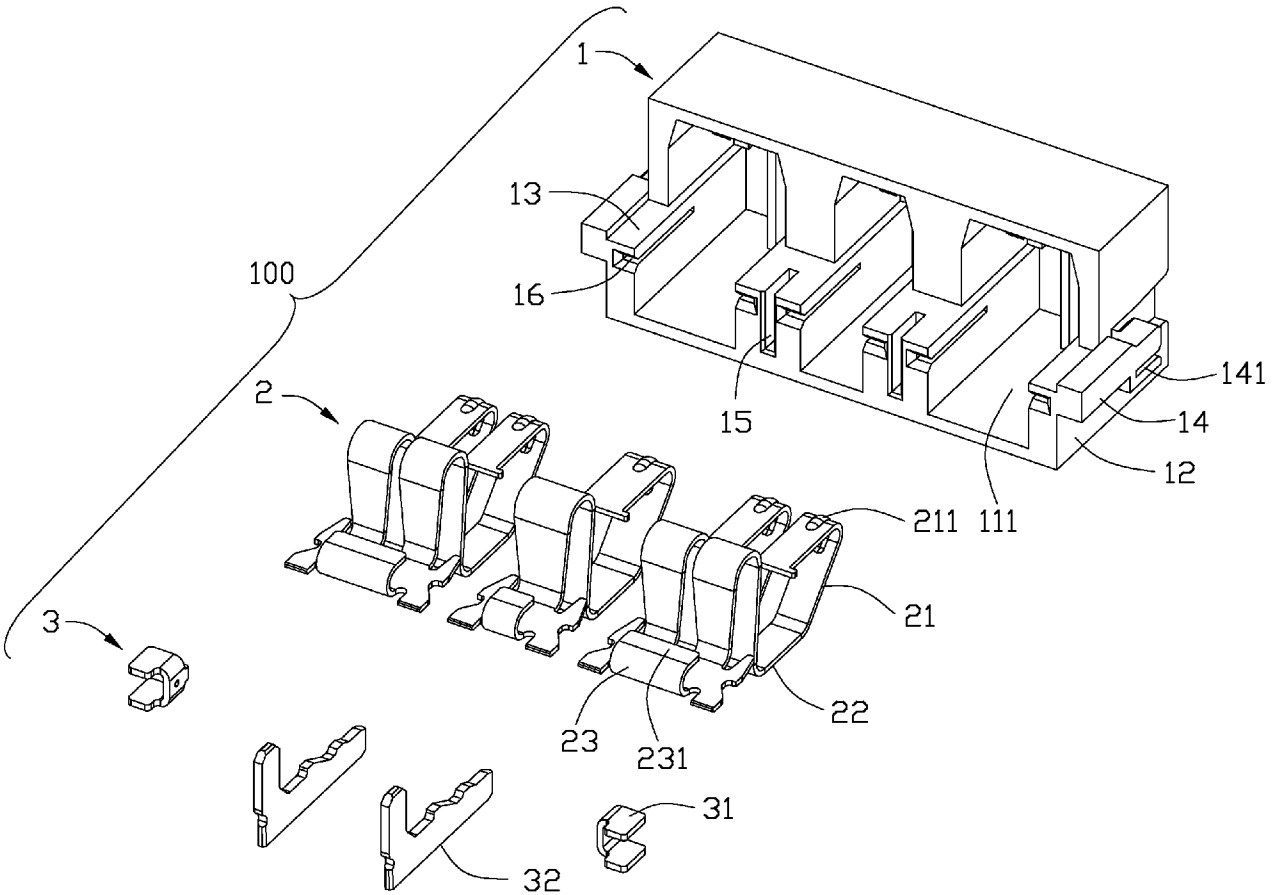
FIG. 4 is another exploded, perspective view of the battery connector of FIG. 1.

With reference to FIGS. 1 to 3, a battery connector 100 in accordance with the present invention comprises a housing 1 defining a pair of reinforcements 14 in both sides of the housing 1 and a plurality of slots 111, a plurality of contacts 2 received in the slots 111, a pair of reinforce metal parts 31 and a pair of soldering hooks 32. The metal parts 31 and the solding hooks 32 serve as a plurality of retention elements 3 for retaining the battery connector 100 onto a printed circuit board (not shown) securely.

The housing 1 is generally a block-shaped member and made of plastic material or the like. The housing 1 comprises a base portion 11 and a protruding portion 12 extending backwardly from the base portion 11. The slots/passageways 111 of the housing 1 are through holes from the rear end of the housing 1 to the front end. Each slot/passageway 111 has two sidewalls, every middle wall between adjacent two slots/passageways 111 defines an inserting opening 15, and every sidewall has a narrow gap. The housing 1 defines a mounting face 13 in the rear portion thereof. The housing 1 further defines an abutment face 16 in each of the slots/passageways 111 and extending along the mating direction. The mounting face 13 is higher than the abutment face 16. Each slot/passageway 111 has a mating opening at the front end of the slot/passageway 111, and defines lateral wall 113 in which a recess 112 locates. The recess 112 defines opposed side walls to limit the rib 211 of the contact 2 to move along a left-to-right direction within a predetermined distance defined by said opposed side walls of the recess 112. Said pair of reinforcement 14 in both sides of the housing 1 form U-shape grooves 141 in which the metal parts 31 are inserted and positioned.

Each contact 2 includes a mating portion 21 defining a rib 211 in a centre of the mating portion 21 and an elastic arm 22 adjoining the mating portion 21 and a soldering foot 23 defining a pair of fins inserted in the gap of sidewall in sides of the foot 23. The soldering foot 23 has a soldering face 231.

A pair of L-shaped hook 32 inserted into the inserting openings 15 of the housing 1, the hook 32 can fixed in a print circuit board into which the battery connector 100 is assembled. The hooks 32 have agnail in order to seize the housing 1 and bind the housing 1 and the print circuit board together.

Said U-shaped metal part 31 can put in the grooves 141, and one side face 311 of the metal part 31 coplanar with the soldering faces 231 of the contacts 2 is soldered to the print circuit board.

When assembled, the contacts 2 is inserted in the slots 111 of the housing 1, the mating portions 21 of the contacts extend out from the mating opening of the slots 111, the fins of the soldering foot 23 is received in gaps of the housing 1, the metal part 31 is fixed in the grooves 141, the hook 32 inserted into the inserting openings 15 of the housing 1, U-shaped metal part 31 and the soldering face of the contacts 2 have the common mounting face 13 soldering to a print circuit board.

Figure 5:
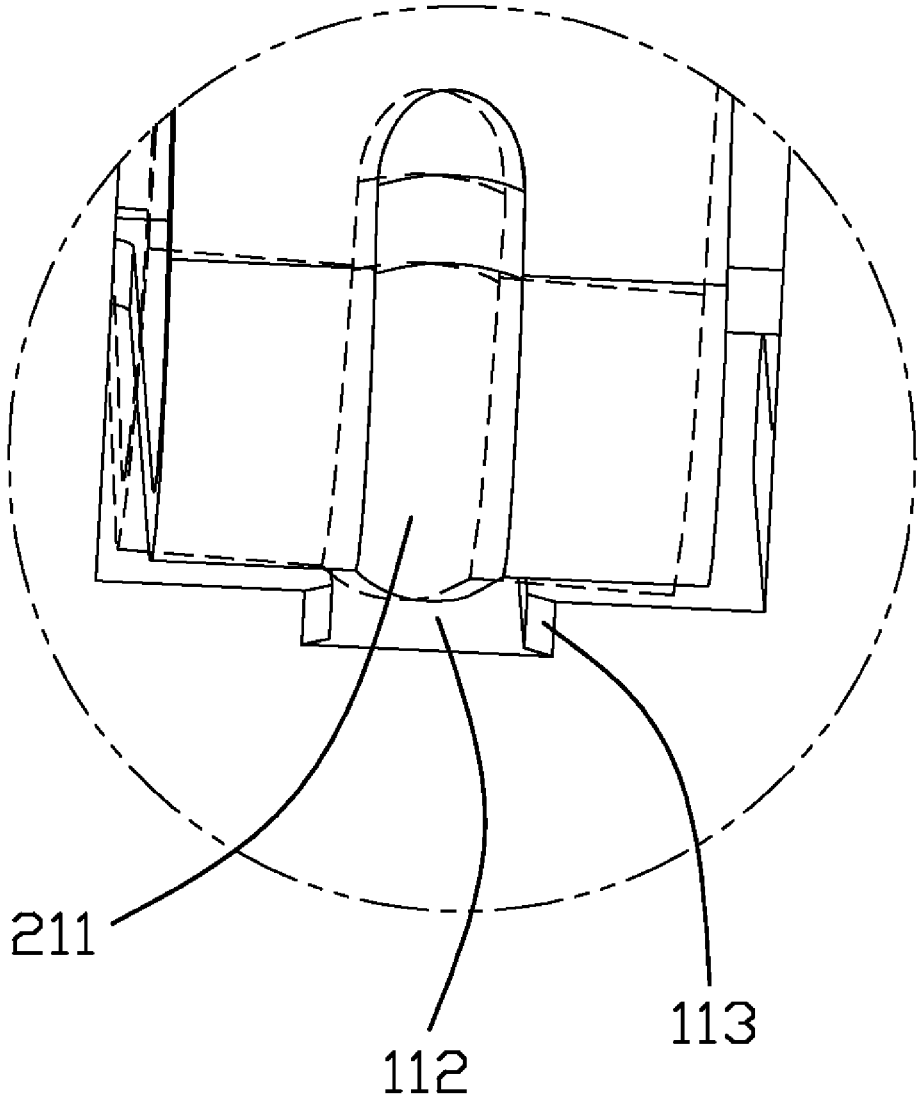
FIG. 5 is a partly-enlarged drawing of FIG.1, showing a mating section of the battery connector moveable to a left position.
Figure 6:
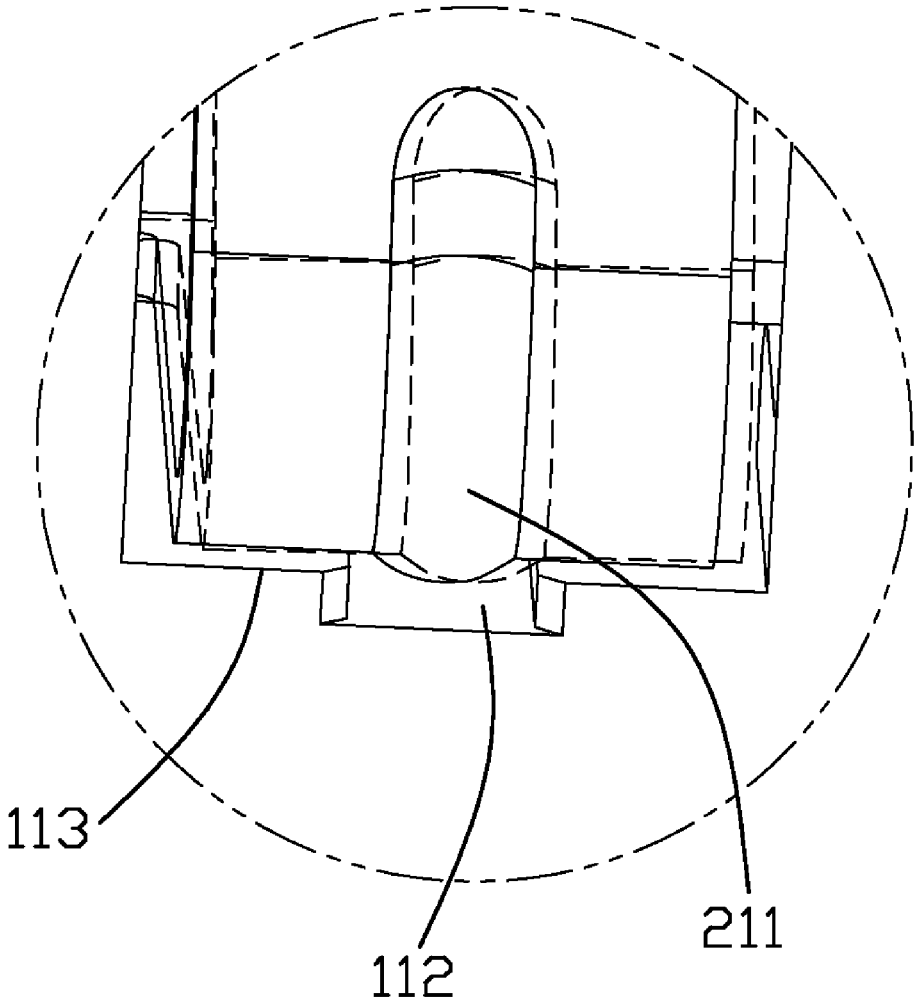
FIG. 6 is another partly-enlarged drawing of FIG. 1, showing the mating section of the battery connector moveable to a right position.

With reference to FIG. 5 and FIG. 6, the pushed contact 2 respectively moves to a left side position and a right position. The rib 211 restrictively moves along a left-to-right direction within a predetermined distance defined by said opposed side walls of the recess 112 in order to prevent disengagement of the contact 2 and a complementary element.

A battery connector is generally assembled in a corner of a case, when a battery is inserted in the case, the contacts 2 of the battery connector 100 would be pushed departing from central axis of the slots 111. In the present invention the rib 211 of the contacts 2 plunged into the recess 112 of the slots 111 solving the displacement of the contacts 2.

The forgoing descriptions disclose the embodiments of the present invention but do not intend to limit the present invention. Additional advantages and modifications will readily occur to those skilled in the art. Therefore, the invention in its broader aspects is not limited to the specific details and representative embodiments shown and described herein. Accordingly, various modifications and variations may be made without departing from the scope of the invention as defined by the appended claims and their equivalents.

What is claimed is:

1. A battery connector, comprising:

an insulative housing receiving a plurality of contacts in several slots of the housing, the housing defining a pair of reinforcements in both sides of the housing;

each contact having a mating portion defining a rib in a centre of the mating portion and a soldering foot at an end of the contact;

a metal part mounted with each of the reinforcements;

wherein the soldering foot defines a soldering face and the metal part has a side face coplanar with the soldering face, each slot has a lateral wall opposite to the mating portion, and the lateral wall has a recess in which the rib of the contact can be accommodated when the contact is plunged downward.

2. The battery connector as described in claim 1, wherein said metal part is U-shaped, said reinforcement has a U-shaped groove, the metal part fitted to the groove has a soldering face in one side of the metal part.

3. The battery connector as described in claim 2, wherein said soldering foot has fins in both sides of the soldering foot, and the slot has gaps in both side walls of the slot, the fins are fixed in the gaps.

4. The battery connector as described in claim 3, wherein said battery connector has a top face and a bottom face, said mounting face is between the top face and the bottom face.

5. A battery connector, comprising:

an insulative housing having a plurality of passageways extending through the housing along a front-to-back direction;

a plurality of terminals received in the respective passageways with each having a mating section extending forwardly from a front face of the housing, a rib defined on the mating section of each of said contacts;

a plurality of recesses on said front face of the housing to extend from the front face toward a back face of the housing and being in communication with the respective passageways, each of the recesses in correspondence with each of the ribs and defining opposed side walls to limit the rib of the contact to move along a left-to-right direction within a predetermined distance defined by said opposed side walls of the recess.

6. An electrical connector comprising:

an insulative housing defining a mating face;

a plurality of passageways defined in the housing and extending through said mating face, respectively, along a mating direction;

an abutment face of the housing defining in each of said passageways and extending along said mating direction;

a recess formed in each corresponding abutment face and extending in said mating direction; and a plurality of contacts disposed in the corresponding passageways, respectively, each of said contacts including an mating portion extending forwardly beyond the mating face, a rib formed on the corresponding mating portion of each of said contacts and forming a contact point thereof; wherein during mating, the mating portion moves along the abutment face in the corresponding passageway along the mating direction, and the rib moves along and in the corresponding recess along the mating direction as well.

7. The electrical connector as claimed in claim 6, wherein said passageway is dimensioned to allow the corresponding contact to deviate sideward with a limited range, and the recess is dimensioned to allow the corresponding rib to deviate sideward with another limited range as well.

8. The electrical connector as claimed in claim 6, wherein each of said contacts includes a U-shaped structure between a mounting tail and the mating portion.

9. The electrical connector as claimed in claim 8, wherein said mounting tail is higher than the abutment face.

* * * * *